US010549950B2

(12) United States Patent
Aitamurto et al.

(10) Patent No.: US 10,549,950 B2
(45) Date of Patent: Feb. 4, 2020

(54) METHOD AND AN ARRANGEMENT FOR ENABLING MOVEMENT OF THE ELEVATOR WHILE A MAINTANENCE TECHNICIAN IS IN THE PIT

(71) Applicant: KONE Corporation, Helsinki (FI)

(72) Inventors: Juha-Matti Aitamurto, Hyvinkää (FI); Pekka Laukkanen, Hyvinkää (FI); Ari Kattainen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 481 days.

(21) Appl. No.: 15/387,383

(22) Filed: Dec. 21, 2016

(65) Prior Publication Data

US 2017/0174474 A1 Jun. 22, 2017

(30) Foreign Application Priority Data

Dec. 22, 2015 (EP) ..... 15201824

(51) Int. Cl.
*B66B 1/34* (2006.01)
*B66B 5/00* (2006.01)
*B66B 1/02* (2006.01)

(52) U.S. Cl.
CPC ..... *B66B 5/0087* (2013.01); *B66B 1/02* (2013.01); *B66B 5/005* (2013.01)

(58) Field of Classification Search
CPC ..... B66B 5/0087; B66B 1/02; B66B 5/005; B66B 5/0056
USPC ..... 187/247, 391, 393, 394, 293, 298
See application file for complete search history.

(56) References Cited

U.S. PATENT DOCUMENTS 5,721,403 A * 2/1998 Hoppie ..... B66B 5/0087 187/247
6,550,585 B2 * 4/2003 Schoppa ..... B66B 5/005 187/280
7,448,473 B2 * 11/2008 Lindberg ..... B66B 1/34 187/384
7,575,102 B2 * 8/2009 Matsuoka ..... B66B 5/0093 187/391
7,891,467 B2 * 2/2011 Kattainen ..... B66B 5/0056 187/316
7,954,606 B2 * 6/2011 Tinone ..... B66B 5/005 187/384

(Continued)

FOREIGN PATENT DOCUMENTS

EP 2 072 450 A1 6/2009
EP 2 623 452 A1 8/2013
WO WO 2013/061355 A1 5/2013

*Primary Examiner* — Anthony J Salata
(74) *Attorney, Agent, or Firm* — Birch, Stewart, Kolasch & Birch, LLP

(57) ABSTRACT

The method of performing maintenance of an elevator is performed by unlocking and opening a landing door at a lowermost landing manually, activating a first stop button in the shaft, whereby a safety circuit of the elevator is opened so that operation of the car is completely prevented, entering into the shaft, closing the landing door, climbing down from the lowermost landing to the pit, turning a drive switch in a maintenance control unit positioned in the pit into a maintenance drive mode, whereby the first stop button is bypassed so that the car can be driven from the maintenance control unit upwards and downwards in the shaft.

2 Claims, 3 Drawing Sheets

(56) References Cited

U.S. PATENT DOCUMENTS

| | | | | |
|---|---|---|---|---|
| 8,261,885 | B2 * | 9/2012 | Ketoviita | B66B 5/0043 187/314 |
| 8,490,755 | B2 * | 7/2013 | Lindberg | B66B 13/22 187/314 |
| 9,061,863 | B2 * | 6/2015 | Birrer | B66B 13/22 |
| 9,272,878 | B2 * | 3/2016 | Kocher | B66B 5/005 |
| 9,403,663 | B2 * | 8/2016 | Dellarippa | B66B 1/34 |
| 10,118,798 | B2 * | 11/2018 | Kattainen | B66B 5/0031 |
| 2017/0113900 | A1 * | 4/2017 | Litteral | B66B 5/0043 |
| 2019/0077632 | A1 * | 3/2019 | Kondo | B66B 5/0025 |

* cited by examiner

METHOD AND AN ARRANGEMENT FOR ENABLING MOVEMENT OF THE ELEVATOR WHILE A MAINTANENCE TECHNICIAN IS IN THE PIT

FIELD OF THE INVENTION

The invention relates to a method and an arrangement for maintenance operation of an elevator.

BACKGROUND ART

An elevator comprises typically a car, an elevator shaft, a machine room, lifting machinery, ropes, and a counter weight. The elevator car is positioned within a sling that supports the car. The lifting machinery comprises a sheave, a machinery brake and an electric motor for rotating the sheave. The lifting machinery moves the car in a vertical direction upwards and downwards in the vertically extending elevator shaft. The ropes connect the sling and thereby also the car via the sheave to the counter weight. The sling is further supported with gliding means on guide rails extending in the vertical direction in the shaft. The gliding means can comprise rolls rolling on the guide rails or gliding shoes gliding on the guide rails when the elevator car is mowing upwards and downwards in the elevator shaft. The guide rails are supported with fastening brackets on the side wall structures of the elevator shaft. The gliding means engaging with the guide rails keep the car in position in the horizontal plane when the car moves upwards and downwards in the elevator shaft. The counter weight is supported in a corresponding way on guide rails supported on the wall structure of the shaft. The elevator car transports people and/or goods between the landings in the building. The elevator shaft can be formed so that the wall structure is formed of solid walls or so that the wall structure is formed of an open steel structure.

The elevator shaft is provided with a pit below the lowermost landing of the shaft. In a case the depth of the pit is more than 1.6 m, two stop buttons are required for maintenance operations to be performed from the pit. The first stop button should be positioned in the shaft above the floor of the lowermost landing so that a mechanic can operate the first stop button when he is standing on the lowermost landing and the landing door is opened. The second stop button should be positioned in the pit either separately or on a maintenance drive unit positioned in the pit. Operation of the car is prevented completely when the first or the second stop button is activated as they are part of the safety circuit of the elevator.

The pit can be accessed from the lowermost landing when the car is positioned above the landing door of the first landing. The mechanic may open the lock of the landing door at a landing with a triangle key, whereby the operation mode of the elevator is changed into maintenance mode preventing normal operation of the elevator. The elevator can still be operated in maintenance mode e.g. from a maintenance access panel positioned near a landing door at a landing. Also opening of the hatch of the maintenance access panel with the triangle key will change the operation mode of the elevator into maintenance mode preventing normal operation of the elevator. After unlocking the landing door, the mechanic opens the landing door manually by force in order to be able to enter into the shaft and to climb down to the pit with a ladder. The mechanic closes the landing door manually from the shaft after entering into the shaft in order to prevent third parties and objects from falling into the pit.

The elevator car must naturally be positioned above the landing door of the lowermost landing before the mechanic can enter into the shaft in order to climb down to the pit. The mechanic may drive the elevator car in maintenance mode from the maintenance access panel to a position above the landing door of the lowermost landing if this is needed.

The procedure when entering into the pit is the following:

1. The mechanic opens the lock of the landing door at the lowermost landing with a triangular key, opens the landing door manually and activates the first stop button positioned within the shaft from the lowermost landing, enters into the shaft and closes the landing door manually from the inside of the shaft. Opening of the lock of the landing door sets the main control unit into maintenance mode preventing normal operation of the car. Activation of the first stop button opens the safety circuit of the elevator preventing operation of the car completely.

2. The mechanic climbs down along a ladder to the bottom of the pit and activates the second stop button positioned on the maintenance control unit and turns a drive switch on the maintenance control unit into a maintenance operation mode.

3. The mechanic climbs up along the ladder and deactivates the first stop button. The second stop button is still activated at this stage preventing operation of the car.

4. The mechanic climbs again down along the ladder and deactivates the second stop button. The mechanic can now drive the car with the maintenance control unit in maintenance mode downwards in the shaft to a position in which the mechanic can perform maintenance of the equipment positioned in connection with the bottom of the car.

When the mechanic has performed the intended maintenance operation he must repeat the same procedure in a reverse order.

1. The mechanic drives the car with the maintenance control unit into a position above the landing door of the lowermost landing and activates the second stop button.

2. The mechanic climbs up along the ladder and activates the first stop button.

3. The mechanic climbs down along the ladder and turns the drive switch on the maintenance control unit into an inactive operation mode and deactivates the second stop button. The first stop button is still activated at this stage preventing operation of the car.

4. The mechanic climbs up along the ladder, opens the landing door on the lowermost landing, enters into the lowermost landing, deactivates the first stop button, and locks the landing door with the triangular key.

Deactivation of the first stop button closes the safety circuit as the second stop button has been deactivated already earlier. Locking of the landing door at the lowermost landing with the triangular key will restore the elevator into normal operation mode.

This procedure is rather cumbersome as the mechanic has to climb up and down from the pit along the ladder several times. There is also a tripping risk when the mechanic has to climb several times up and down along the ladder in the shaft. There is further the risk that the mechanic will be tempted to short cut the tedious procedure. The mechanic might by mistake or deliberately forget to activate the first stop button when he enters into the shaft and climbs down the ladder to the pit.

This hazard has been prevented in prior art solutions so that the control logic of the elevator has been set to identify such a maintenance situation and to remember the situation. The control logic of the elevator identifies the start of the maintenance operation cycle when the mechanic opens the lock of the lowermost landing door with the triangle key. The control logic of the elevator remembers this maintenance operation cycle and prevents operation of the car until the maintenance operation cycle has been signed off by the mechanic at the maintenance access panel.

The singular i.e. landing door is used throughout the application, but the landing door could naturally comprise one or several door panels. The landing door could be a swing type door or a gliding type door. The swing type door and the gliding type door could comprise one or several door panels.

BRIEF DESCRIPTION OF THE INVENTION

An object of the present invention is to achieve an improved method and arrangement for maintenance operation of an elevator.

The elevator comprises a car moving upwards and downwards between landings in a shaft being provided with a pit at a bottom of the shaft. The method comprises:

unlocking and opening landing door at a lowermost landing manually, whereby normal operation of the car is prevented, activating a first stop button at the lowermost landing in the shaft, whereby a safety circuit of the elevator is opened so that operation of the car is prevented, entering into the shaft from the lowermost landing, closing the landing door, and climbing down to the bottom of the pit, turning a drive switch in a maintenance control unit positioned in the pit into a maintenance drive mode, whereby the first stop button is by-passed so that the car can be driven in maintenance mode from the maintenance control unit upwards and downwards in the shaft.

The arrangement comprises:

a first stop button being positioned at a lowermost landing in the shaft, said first stop button forming a part of a safety circuit of the elevator, whereby activation of said first stop button opens the safety circuit so that operation of the car is prevented, a maintenance control unit being positioned in the pit, said maintenance control unit comprising a drive switch having a maintenance drive mode in which the first stop button is by-passed so that the car can be driven in maintenance mode from the maintenance control unit upwards and downwards in the shaft.

The invention makes the maintenance operation procedure in a shaft provided with a deep pit requiring two stop buttons much smoother compared to prior art solutions. There is no need for the mechanic to climb up and down the ladder several times at the beginning and at the end of the maintenance procedure. The mechanic has to climb down to the pit along the ladder only once at the beginning of the maintenance procedure and up from the pit along the ladder only once after completion of the maintenance procedure.

The hazards related to the climbing upwards and downwards along the ladder are also reduced in the invention. The mechanic need to climb only once downwards and once upwards along the ladder in the inventive method and arrangement.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
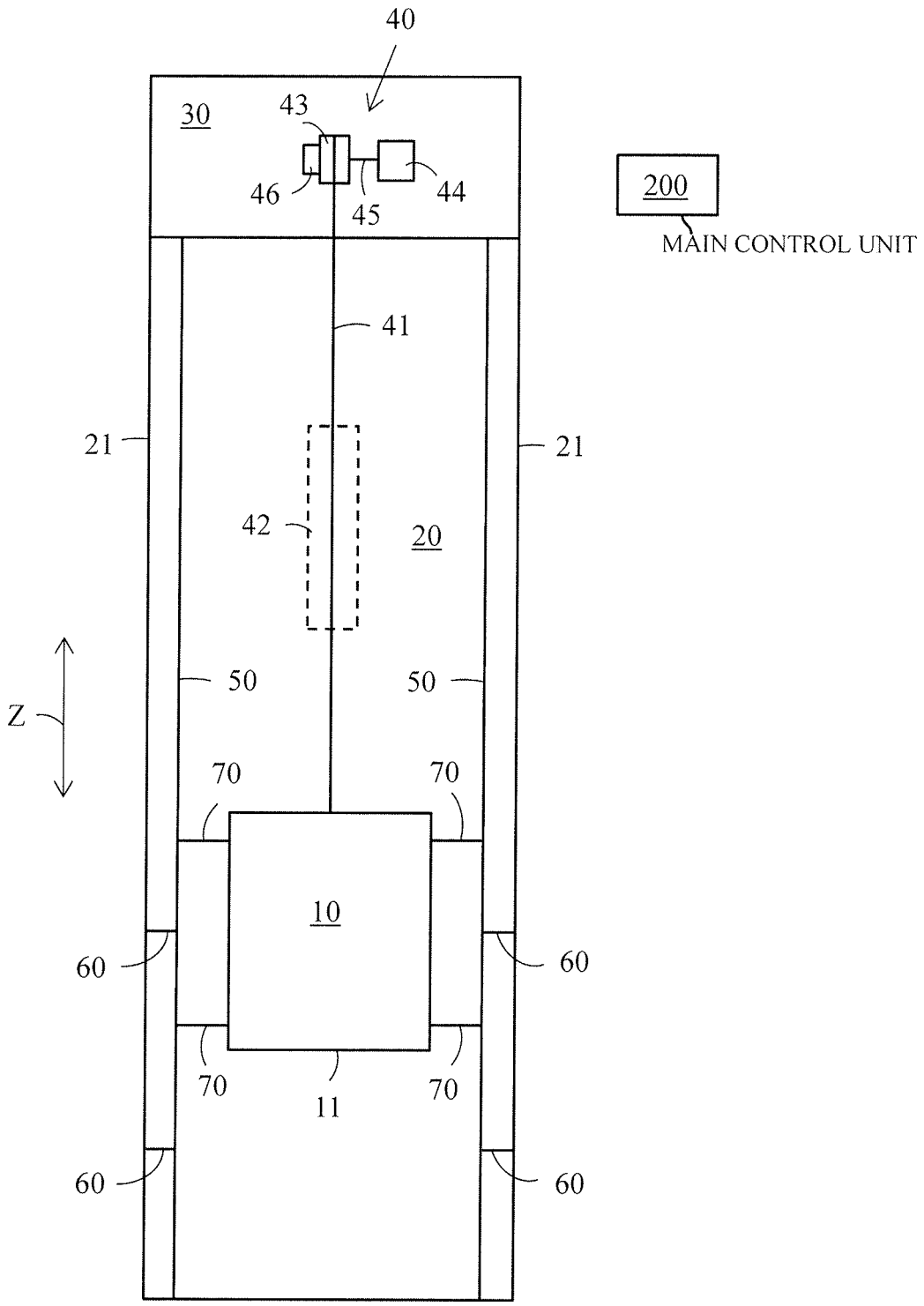
CONVENTIONAL ART FIG. 1
FIG. 1 shows a first vertical cross section of an elevator.

FIG. 1 shows a vertical cross section of an elevator. The elevator comprises a car 10, an elevator shaft 20, a machine room 30, lifting machinery 40, ropes 41, and a counter weight 42. A frame called sling 11 surrounds the car 10. The lifting machinery 40 comprises a sheave 43, a machinery brake 46 and an electric motor 44 for rotating the sheave 43 via a shaft 45. The lifting machinery 40 moves the car 10 in a vertical direction Z upwards and downwards in the vertically extending elevator shaft 20. The sling 11 is connected by the ropes 41 via the sheave 43 to the counter weight 42. The sling 11 is further supported with gliding means 70 at guide rails 50 extending in the vertical direction in the shaft 20. The figure shows two guide rails 50 at opposite sides of the car 10. The gliding means 70 can comprise rolls rolling on the guide rails 50 or gliding shoes gliding on the guide rails 50 when the car 10 is moving upwards and downwards in the elevator shaft 20. The guide rails 50 are attached with fastening brackets 60 to the side wall structures 21 in the elevator shaft 20. The figure shows only two fastening brackets 60, but there are several fastening brackets 60 along the height of each guide rail 50. The gliding means 70 engaging with the guide rails 50 keep the car 10 in position in the horizontal plane when the car 10 moves upwards and downwards in the elevator shaft 20. The counter weight 42 is supported in a corresponding way on guide rails that are attached to the wall structure 21 of the shaft 20. The machinery brake 46 stops the rotation of the sheave 43 and thereby the movement of the elevator car 10. The car 10 transports people and/or goods between the landings in the building. The elevator shaft 20 can be formed so that the wall structure 21 is formed of solid walls or so that the wall structure 21 is formed of an open steel structure.

Figure 2:
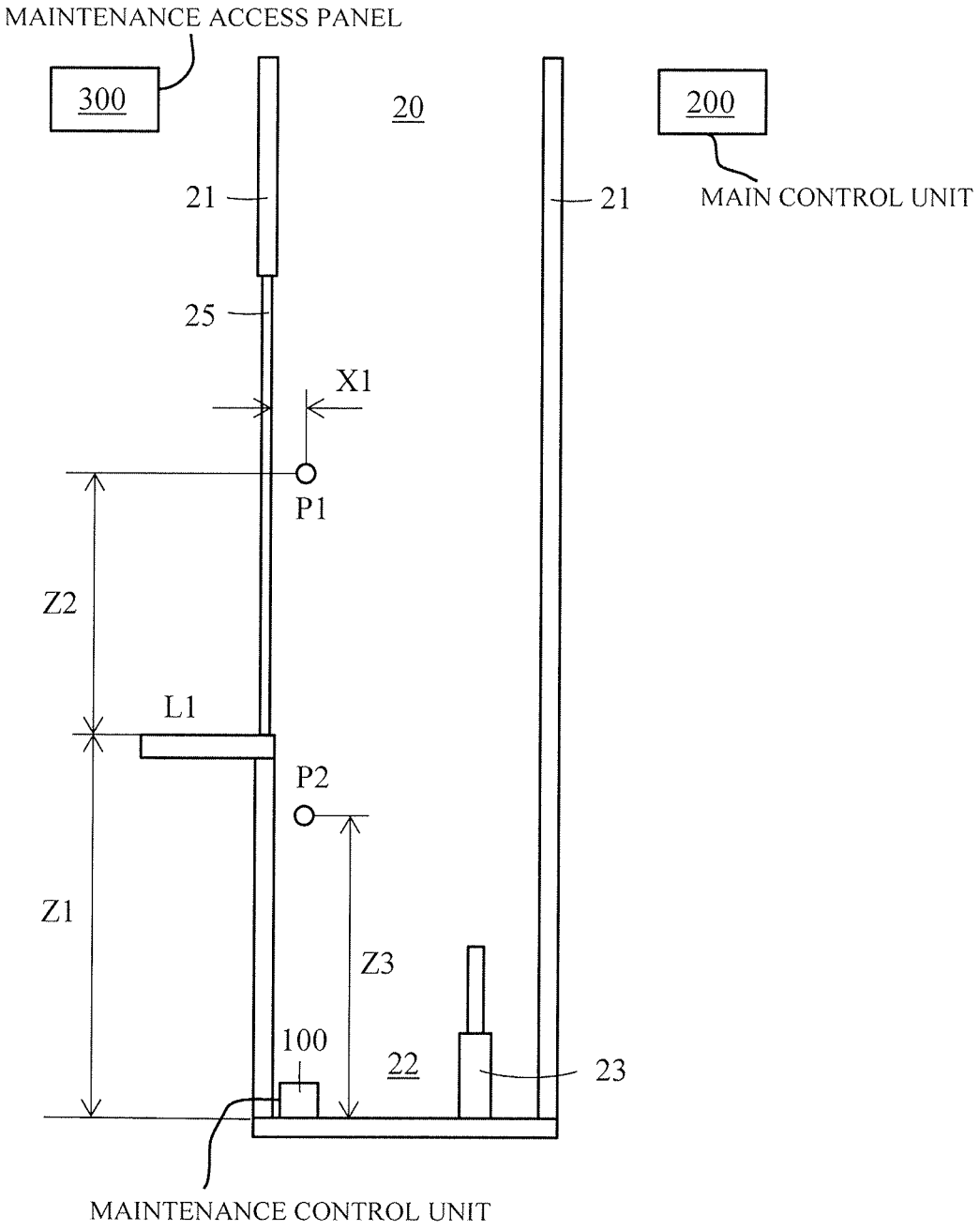
FIG. 2 shows a second vertical cross section of the lower region of an elevator shaft.

FIG. 2 shows a second vertical cross section of the lower region of an elevator shaft. The figure shows the pit 22 at the bottom of the shaft 20 below the lowermost landing L1. There are buffers 23 at the bottom of the pit 22 for softening the stop of the car 10 if it tries to run at full speed to the bottom of the shaft 20. In a case the depth Z1 of the pit 22 is more than 1.6 m, two stop buttons P1, P2 are required for maintenance operations to be performed from the pit 22. The first stop button P1 should be positioned in the shaft 20 above the floor of the lowermost landing L1 at a height Z2 of at least 1.0 m from the floor of the lowermost landing L1. The horizontal distance X1 from the front wall 21 of the shaft 20 to the first stop button P1 should be equal to or less than 0.75 m. The idea is that a mechanic should be able to operate the first stop button P1 when he is standing on the lowermost landing L1 and the landing door L1 is opened. The second stop button P2 should be positioned in the pit 22 at a height Z3 of less than 1.2 m above the floor of the pit 22. A maintenance drive unit 100 is positioned in the pit 22 e.g. at the bottom of the pit 22. The second stop button P2 may be positioned on the maintenance drive unit 100. Activation of the first stop button P1 or the second stop button P2 will open the safety circuit of the elevator preventing operation of the car 10 completely.

The pit 22 can be accessed from the lowermost landing L1 when the car 10 is positioned above the landing door 25 of the lowermost landing L1. The mechanic may open the locking of the landing door 25 at the lowermost landing L1 with a triangle key, whereby the main control unit 200 of the elevator is set into a maintenance mode. Normal operation of the car 10 is prevented in the maintenance mode. The elevator car 10 can still be operated in maintenance mode e.g. from a maintenance access panel 300 positioned near a landing door at a landing. After unlocking the landing door 25 at the lowermost landing L1 with the triangle key, the mechanic opens the landing door 25 manually by force in order to be able to enter into the shaft 20 and to climb down to the pit 20 with a ladder. The mechanic closes the landing door 25 manually from the inside of the shaft 20 after entering into the shaft 20 in order to prevent third parties and objects from falling into the pit 22. The mechanic does not, however, lock the landing door 25 from the inside with the triangular key. The elevator should be kept in the maintenance mode all the time the mechanic is in the shaft 20.

The maintenance access panel 300 is not necessarily positioned at the lowermost landing L1 and the landing door 25 is anyway closed when the mechanic is in the pit 22. There is thus a danger that a second mechanic may reset the elevator from the maintenance access panel 300. The second mechanic may change the operation mode from maintenance mode to normal operation mode or he may drive the car 10 within inspection drive in maintenance mode as he might not be aware of the first mechanic in the pit 22. The first mechanic in the pit 22 may thus be injured in case he is climbing up or down along the ladder in the pit 22 when the car 10 moves downwards. The buffers 23 at the bottom of the pit 22 will protect the first mechanic when he is at the bottom of the pit 22. In order to prevent this hazard there is a first stop button P1 in the shaft 20 at the level of the landing door 25 at the lowermost landing L1. This first stop button P1 opens the safety circuit of the elevator and prevents normal operation as well as inspection drive in maintenance operation of the car 10.

When the mechanic has climbed down to the bottom of the pit 22 and wants to get access to the equipment to be maintained e.g. the safety gear positioned in connection with the bottom of the car 10, he uses the maintenance control unit 100 in the pit 22 in order to drive the car 10 in maintenance mode downwards to a suitable level. In order to be able to drive the car 10 from the maintenance control unit 100 at the bottom of the pit 22, the mechanic must deactivate the first stop button P1 so that the safety circuit is again closed. After he has deactivated the first stop button P1 the mechanic may drive the car 10 from the maintenance control unit 100. In case the pit 22 is so deep that the mechanic does not reach the first push button P1 from the bottom of the pit 22, he must climb up along the ladder to the first push button P1 and then down again along the ladder to the bottom of the pit 22. The mechanic is exposed to the original hazard when he climbs down along the ladder after he has deactivated the first stop button P1 and when he climbs up from the pit 22 along the ladder after he has finished the maintenance work. The car 10 may be driven from the maintenance access panel 300 by a second mechanic who is not aware of the first mechanic in the pit 22.

In order to eliminate this hazard, two stop buttons P1, P2 are required in a pit 22 having a depth of more than 1.6 m. It is quite normal in elevators of today that the depth of the pit 22 is more than 1.6 m, e.g. at a car velocity of 6 m/s, the depth of the pit 22 should be 4 m. Both stop buttons P1, P2 form part of the safety circuit of the elevator. This means that both stop buttons P1, P2 must be deactivated i.e. the contact must be closed in order to be able to operate the car 10. The first stop button P1 is positioned within the shaft 20 at the lowermost landing L1. The second stop button P2 is positioned in the pit 22 or in the maintenance control unit 100. The procedure when entering into the pit 22 is the following:

1. The mechanic unlocks the lock of the landing door 25 at the lowermost landing L1 with a triangular key, opens the landing door 25 manually and activates the first stop button P1 positioned within the shaft 20 from the lowermost landing L1, enters into the shaft 20 and closes the landing door 25 from the inside of the shaft 20. Opening of the lock of the landing door 25 sets the main control unit 200 of the elevator into maintenance mode preventing normal operation of the car 10. Activation of the first stop button P1 opens the safety circuit S1, S2 of the elevator preventing operation of the car 10 completely.

2. The mechanic climbs down along a ladder to the bottom of the pit 22 and activates the second stop button P2 positioned on the maintenance control unit 100 and turns a drive switch on the maintenance control unit 100 into a maintenance operation mode.

3. The mechanic climbs up along the ladder from the pit 22 and deactivates the first stop button P1. The second stop button P2 is still activated at this stage preventing operation of the car 10.

4. The mechanic climbs again down to the bottom of the pit 22 along the ladder and deactivates the second stop button P2. The mechanic can now drive the car 10 with the maintenance control unit 100 in maintenance mode downwards in the shaft 20 to a position in which the mechanic can perform maintenance of the equipment positioned in connection with the bottom of the car 10.

When the mechanic has finished the intended maintenance operation he must repeat the same procedure in a reverse order.

1. The mechanic drives the car 10 with the maintenance control unit 100 into a position above the landing door 25 of the lowermost landing L1 and activates the second push button P2. Activation of the second push button P2 opens the safety circuit of the elevator preventing operation of the car 10 completely.

2. The mechanic climbs up along the ladder from the pit 22 and activates the first stop button P1.

3. The mechanic climbs down along the ladder to the bottom of the pit 22 and turns the drive switch on the maintenance control unit 100 into an inactive operation mode and deactivates the second stop button P2. The first stop button P1 is still activated at this stage preventing operation of the car 10.

4. The mechanic climbs up along the ladder, opens the landing door 25 on the lowermost landing L1, enters into the lowermost landing L1, deactivates the first stop button P2, closes the landing door 25 manually, and locks the landing door 25 with the triangular key.

Locking of the landing door 25 at the lowermost landing L1 with the triangular key will return the main control unit 200 of the elevator into normal operation mode.

Both stop buttons P1, P2 must be deactivated in this arrangement in order to be able to drive the car 10 with the maintenance operation unit 100 from the pit 22.

This procedure is rather cumbersome as the mechanic has to climb up and down from the pit along the ladder several times. There is also a tripping risk when the mechanic has to climb several times up and down along the ladder in the shaft. There is further the risk that the mechanic will be tempted to short cut the tedious procedure. The mechanic might by mistake or deliberately forget to activate the first stop button P1 when he enters into the shaft 25 and climbs down the ladder to the pit 22. This hazard has been prevented in prior art solutions so that the control logic of the elevator has been set to identify such a maintenance situation and to remember the situation. The control logic of the elevator identifies the start of the maintenance operation cycle when the mechanic opens the locking of the lowermost landing door 25 with the triangle key. The control logic of the elevator remembers this maintenance operation cycle and prevents operation of the car 10 until the maintenance operation cycle has been signed off by the mechanic at the maintenance access panel 300.

Figure 3:
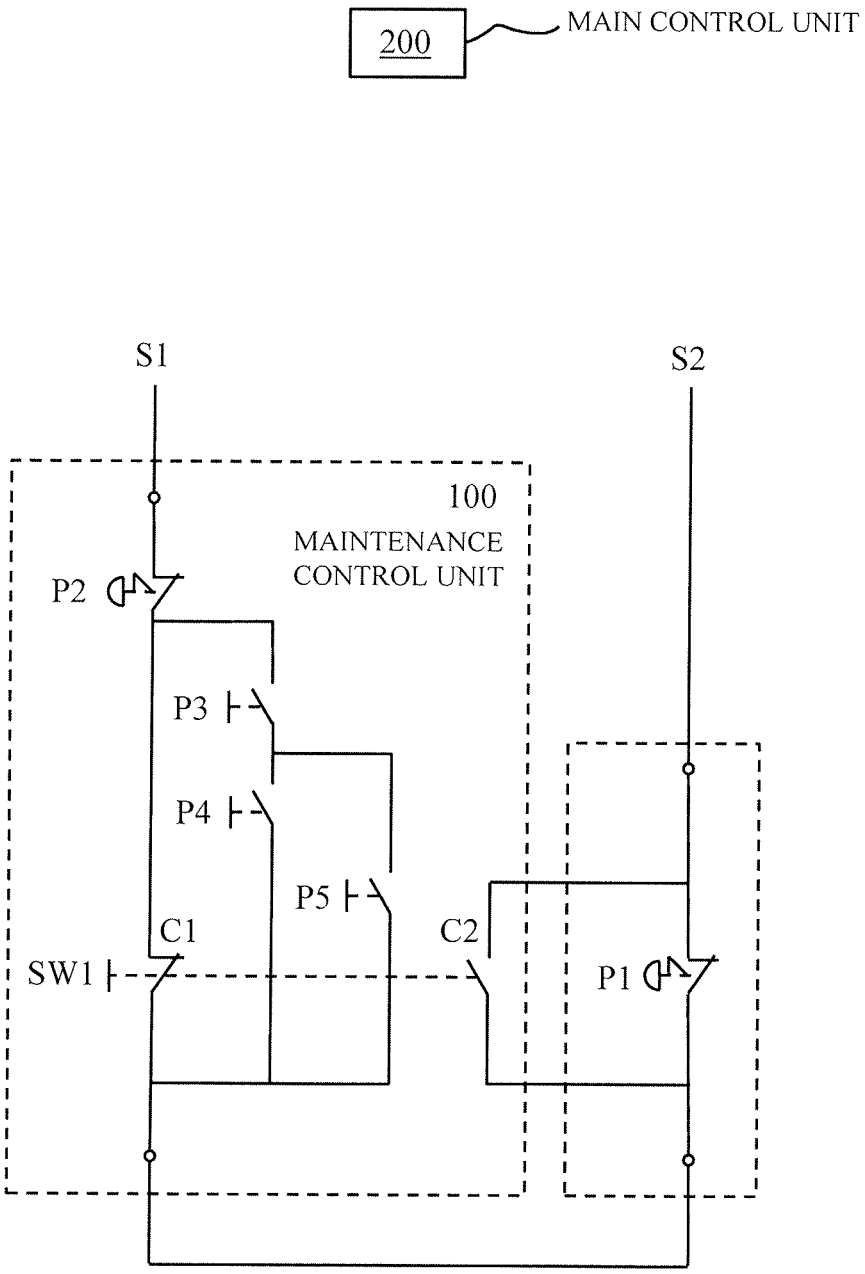
FIG. 3 shows a principal connection implementing the invention.

FIG. 3 shows a principal connection implementing the invention. The circuit diagram shows the first stop button P1 positioned in the shaft 20 at the lowermost landing L1 and the second stop button P2 positioned in the maintenance control unit 100 in the pit 22. The first stop button P1 and the second stop button P2 are connected directly to the safety circuit S1, S2 of the elevator i.e. driving of the elevator car 10 is prevented completely when either of these stop buttons P1, P2 is activated i.e. the contact is open. The maintenance control unit 100 comprises further a drive switch SW1 provided with two contacts C1, C2. The first contact C1 of the drive switch SW1 is connected directly to the safety circuit S1, S2 and the second contact C2 of the drive switch SW1 is connected in parallel with the first stop button P1. When the drive switch SW1 is turned into maintenance drive mode, the first contact C1 is open and the second contact C2 is closed so that the first stop button P1 becomes by-passed. The first contact C1 opens the safety circuit S1, S2 so that it is not possible to drive the car 10 from the maintenance control panel 300. The second contact C2 closes the safety circuit S1, S2 so that driving of the car 10 is only possible from the maintenance control unit 100. The maintenance drive unit 100 comprises further a drive button P3, an upwards button P4 and a downwards button P5 connected in parallel with the first contact C1 of the drive switch S1. The drive button P3 is connected in series with the upwards button P4 and the downwards button P5. The upwards button P4 and the downwards button P5 are connected in parallel after the drive button P3. The drive button P3 has to be pressed in order to be able to drive the car 10. Pressing the drive button P3 and the upwards button P4 will drive the car 10 in maintenance mode upwards. Pressing the drive button P3 and the downwards button P5 will drive the car 10 in maintenance mode downwards. The second stop button P2 is only used as an emergency stop button in this arrangement. The second stop button P2 may be used as an emergency stop button e.g. in case the drive switch SW1 does not for some reason open the safety circuit S1, S2 when it should. The lower ends of the upwards button P4 and the downwards button P5 are naturally connected to their own control lines in order to be able to control the movement of the car 10 in the desired direction.

The procedure when entering into the pit 22 in the arrangement according to the invention is the following:

1. The mechanic unlocks the landing door 25 with the triangular key at the lowermost landing L1, changing the operational mode of the elevator into maintenance mode, and opens the landing door 25 manually.

2. The mechanic activates the first stop button P1 from the landing L1, enters into the shaft 20 and closes the landing door 25 from the inside of the shaft 20. Operation of the car 10 is prevented completely as activation of the first stop button P1 opens the safety circuit S1, S2 of the elevator.

3. The mechanic climbs down along the ladder to the bottom of the pit 22 and turns the drive switch SW1 in the maintenance control unit 100 into maintenance drive mode. The first stop button P1 is thus by-passed i.e. the safety circuit S1, S2 is closed at the first stop button P1. The safety circuit S1, S2 is opened at the first contact C1 of the drive switch SW1 so that the car 10 can be operated only from the maintenance control unit 100.

4. The mechanic drives the car 10 downwards with the maintenance control unit 100 into a suitable position so that he can perform the required maintenance work on the equipment positioned in connection with the bottom of the car 10.

At the end of the maintenance operation the same procedure is repeated in the reverse order.

1. The mechanic drives the car 10 into a position above the doors 25 of the lowermost landing L1 and turns the drive switch SW1 into an inactive mode. The safety circuit S1, S2 is thus opened preventing operation of the car 10 from outside the pit 22.

2. The mechanic climbs up along the ladder to the lowermost landing L1, opens the landing door 25, steps into the landing L1 and deactivates the first stop button P1, closes the landing door 25 and locks it with the triangular key, whereby the safety circuit S1, S2 is closed and the elevator returns to normal operation mode.

The second stop button P2 is in the embodiment of the invention shown in FIG. 3 integrated into the maintenance control unit 100, but this need not be the case. The second stop button P2 could be positioned outside the maintenance control unit 100 somewhere in the shaft 20 in accordance with the safety regulations. Such an embodiment would still be within the scope of the invention.

The use of the invention is naturally not limited to the type of elevator disclosed in FIG. 1, but the invention can be used in any type of elevator e.g. also in elevators lacking a machine room and/or a counterweight. The counterweight could be positioned on either side wall or on both side walls or on the back wall of the elevator shaft. The sheave, the machine brake and the motor could be positioned in the machine room or somewhere in the elevator shaft.

It will be obvious to a person skilled in the art that, as the technology advances, the inventive concept can be implemented in various ways. The invention and its embodiments are not limited to the examples described above but may vary within the scope of the claims.

The invention claimed is:

1. A method for maintenance operation of an elevator, the elevator comprising a car moving upwards and downwards between landings in a shaft being provided with a pit at a bottom of the shaft, the method comprising:

unlocking and opening landing door at a lowermost landing manually, whereby normal operation of the car is prevented, activating a first stop button at the lowermost landing in the shaft, whereby a safety circuit of the elevator is opened so that operation of the car is prevented, entering into the shaft from the lowermost landing, closing the landing door, and climbing down to the bottom of the pit, turning a drive switch in a maintenance control unit positioned in the pit into a maintenance drive mode, whereby the first stop button is by-passed so that the car can be driven in maintenance mode from the maintenance control unit upwards and downwards in the shaft, turning the drive switch in the maintenance control unit positioned in the pit into an inactive mode, whereby the by-pass of the first stop button is deactivated so that the first stop button, which is in the activated state, prevents operation of the car, climbing up from the pit to the lowermost landing, and opening the landing door manually, passing through the landing door opening to the lowermost landing, deactivating the first stop button, closing and locking the landing door manually, whereby the elevator returns to normal operation mode.

2. An arrangement for maintenance operation of an elevator, the elevator comprising a car moving upwards and downwards between landings in a shaft being provided with a pit at a bottom of the shaft, the arrangement comprising:

a first stop button being positioned at a lowermost landing in the shaft, said first stop button forming a part of a safety circuit of the elevator, whereby activation of said first stop button opens the safety circuit so that operation of the car is prevented, a maintenance control unit being positioned in the pit, said maintenance control unit comprising a drive switch having a maintenance drive mode in which the first stop button is by-passed so that the car can be driven in maintenance mode from the maintenance control unit upwards and downwards in the shaft, a second stop button being positioned in the maintenance control unit or in the shaft, said second stop button forming a part of a safety circuit of the elevator, whereby activation of said second stop button opens the safety circuit so that operation of the car is prevented.

* * * * *